United States Patent [19]

Davidson et al.

[11] Patent Number: 4,557,449

[45] Date of Patent: Dec. 10, 1985

[54] POST MOUNTING ASSEMBLY

[75] Inventors: Murray J. Davidson; John E. Chetland, both of Auckland, New Zealand

[73] Assignee: Repco Engineering (NZ) Limited, Auckland, New Zealand

[21] Appl. No.: 564,378

[22] Filed: Dec. 22, 1983

[51] Int. Cl.[4] ..... F16M 13/00

[52] U.S. Cl. ..... 248/160; 40/607; 403/220

[58] Field of Search ..... 248/160, 158, 599; 52/296; 403/220, 221; 404/10, 9, 11; 40/607, 608

[56] References Cited

U.S. PATENT DOCUMENTS

| | | | |
|---|---|---|---|
| 1,071,523 | 8/1913 | Lally | 52/296 |
| 1,502,342 | 7/1924 | Lucas . | |
| 2,767,528 | 10/1956 | Tocci-Guilbert | 403/221 |
| 3,289,369 | 12/1966 | Marcus . | |
| 3,713,611 | 1/1973 | Voigt | 248/160 |
| 3,913,518 | 10/1973 | Kaplan | 248/160 |
| 4,067,528 | 1/1978 | Mötting et al. | 248/160 |
| 4,240,766 | 12/1980 | Smith et al. | 248/160 |

FOREIGN PATENT DOCUMENTS

| | | |
|---|---|---|
| 447473 | 4/1974 | Australia . |
| 2150316 | 4/1973 | Fed. Rep. of Germany . |
| WO80/02167 | 10/1980 | PCT Int'l Appl. . |

*Primary Examiner*—Ramon S. Britts
*Assistant Examiner*—Ramon O. Ramirez
*Attorney, Agent, or Firm*—Holman & Stern

[57] ABSTRACT

A post mounting assembly for mounting a post on a base has a link member provided by a resilient connector which, when the post is subjected to a displacing force that would normally damage the post, deforms to allow the post to detach from and fall clear of the base. The connector thereafter due to its resilient characteristics recovers to allow the post to be remounted on the base.

9 Claims, 5 Drawing Figures

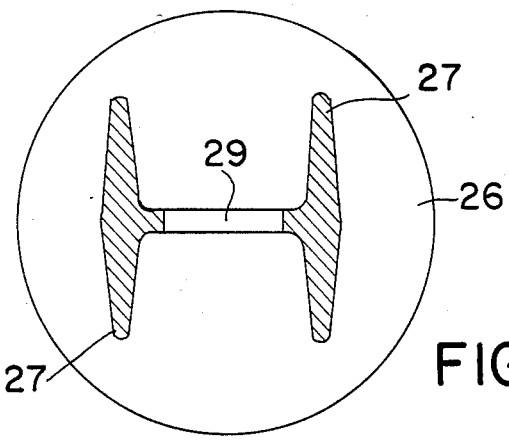
FIG. 2
FIG. 4
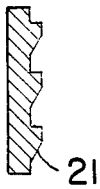
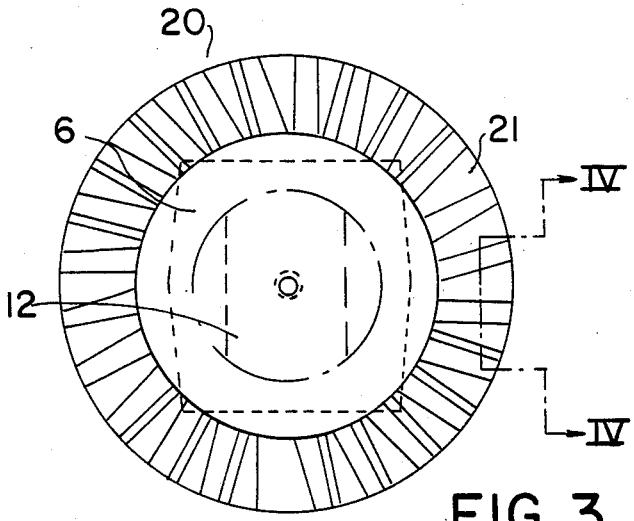
FIG. 3

POST MOUNTING ASSEMBLY

FIELD OF THE INVENTION

This invention relates to post mounts and /or methods of mounting posts.

BRIEF SUMMARY OF THE INVENTION

It is an object of the present invention to provide a connecting member for a post mount, a post mount assembly and/or a method of mounting a post.

Accordingly in one aspect the invention consists in connecting means for placement between a post and a post mounting base, said connecting means being constructed and arranged to, in use, hold said post in substantially fixed association with respect to said base but being elastically deformable to release said post from association with said base, thereafter recovering to allow re-association of said post with said base.

In a further aspect the invention consists in a post mounting assembly comprising a post mounting base; and a post mount connecting means for attachment between said base and one end of a post, said connecting means being constructed and arranged to hold said post in substantially fixed association with said base but being elastically deformable to release said post from association with said base, thereafter recovering to allow re-association of said post with said base.

In still a further aspect the invention consists in a method of mounting a post, said method comprising the steps of fixing a post mounting base at the desired location of said post; and connecting a post to said base by means of post mount connecting means constructed and arranged to hold said post in substantially fixed association with respect to said base but being elastically deformable such that, when a displacing force is applied to said post said connecting means deforms to release said post from said base, the connecting means thereafter recovering to allow re-association of said post with said base.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF THE DRAWINGS

The invention will now be described with reference to the accompanying drawings wherein:

FIG. 2 is a cross-sectional view taken along line II—II in FIG. 1;

FIG. 3 is a top plan view of the base only included in the assembly shown in FIG. 1;

FIG. 4 is a cross-sectional view taken along line IV—IV in FIG. 3; and

DETAILED DESCRIPTION

Figure 5:
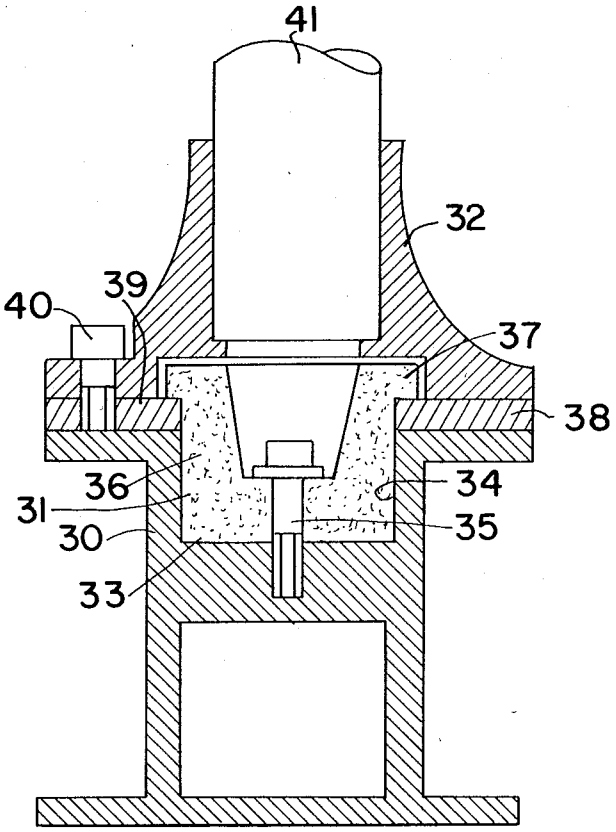
FIG. 5 is a view similar to FIG. 1 of an alternative embodiment of a post mounting assembly according to the invention.

Referring to FIGS. 1 to 5 of the drawings, a post mount assembly 5 is depicted comprising a post mount base 6, and post mount connecting means 7 for maintaining a post 8 in fixed association with the base 6. In the embodiment depicted the post 8 is provided with end fitting 9 to receive connecting means 7.

According to the invention the post mount connecting means 7 is elastically deformable so that when so deformed the association between the post end fitting 9 and the base 6 is released but after recovery of the connecting means 7 the post end fitting 9 may be re-associated with the base 6.

As can be seen the post mount connecting means 7 is preferably in the form of a spigot having a base section 10 and an annular engagement section 11. The base section 10 is received in an annular socket 12 formed in the base 6 and, in the embodiment depicted, is affixed thereto by means of a bolt or like fastener 13.

The outer periphery of the annular engagement section 11 is preferably provided with radially outwardly extending projections 14 which engage in corresponding recesses 15 provided on the inner surface of a further socket 16 formed in the post end fitting 9. In the embodiment depicted in FIG. 1 the radial projections 14 are provided as the male part of a screw thread extending about the periphery of the section 11 of the connecting means 7 and the recesses 15 provided in the post end fitting are provided as the corresponding female section of the thread. Thus post 8 with attached end fitting 9 is simply screwed onto the connecting means 7.

The post mount connecting means 7 is preferably formed from a resilient plastic, rubber or composite plastic/rubber material and the profile of the thread forming the screw fitting between the connecting means 7 and the post end fitting 9 is so configured as to avoid tearing or other fracture of the connecting means 7 when the same is elastically deformed to allow disassocaition of the post 8 from the base 6. We have found that a plastics material sold under the trade mark LURETHANE is a particularly suitable material for the post mount connecting means 7.

The base member 6 is provided with an annular flange 20 which defines the upper surface thereof and surrounds socket section 12. The upper face of flange 20 is provided with ramped teeth 21 (FIGS. 3 and 4).

A flange 22 of similar dimensions defines the lower edge of post end member 9, flange 22 being provided with downward projection 23.

Thus when post 8 is engaged with connecting means 9, the downward projection 23 engages with teeth 21 to prevent reverse rotation between post end member 9 and base 6.

Figure 1:
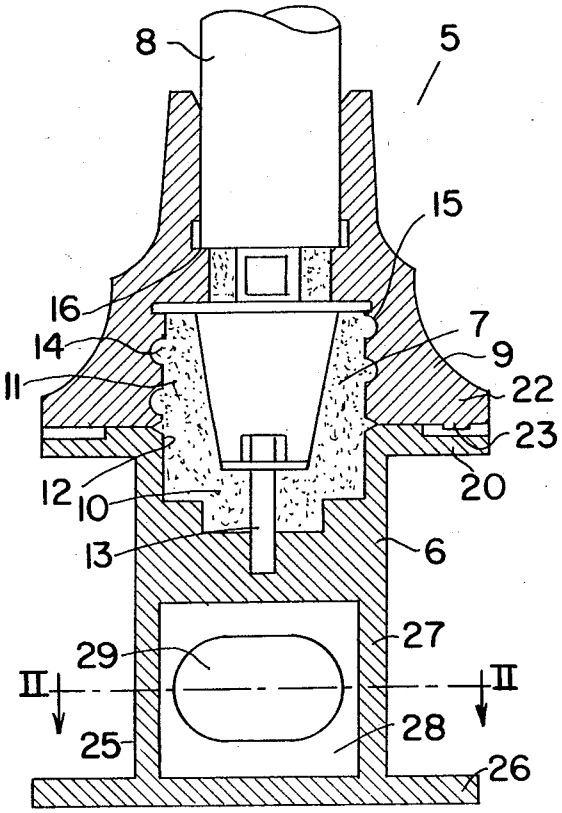
FIG. 1 is a cross-sectional elevational view of one embodiment of a post mounting assembly according to the invention.

It will also be noted from FIGS. 1 and 2 that base 6 has a substantially hollow lower section 25 which assists effective embedding of the base 6 in the ground. The lower section 25 is defined by a circular plate 26 formed integrally with or fixed to the lower end of spaced side plates 27. Flange 28 having a central aperture 29 therein links the plates 26, 27 and the lower end surface of that part of base 6 defining the socket 12 to strengthen the structure.

The post end fitting 9 is as shown preferably press fitted to post 8 but may be fitted in any suitable manner.

In use, the base 6 is permanently fixed in the desired location of the post, for example, by embedding the base 6 in concrete. The base is preferably fixed in position so that the upper surface of flange 20 lies at or adjacent ground surface.

With the post mount connecting means 7 fixed to the base 6 by means of fastener 13, the post 8 with attached end fitting 9 is associated with the base 6 by screwing the fitting 9 to the engagement section 11 of the post mount connecting means 7. Once in position screw disengagement is prevented by downward projection 23 interlocking with teeth 21.

When a displacing force is applied to the post 8 which would, in normal circumstances, bend or otherwise damage the post, the post mount connecting means 7 is constrained to elastically deform and thereby allow the fitting 9 to fall clear of the base 6. Thereafter the connecting means 7 elastically recovers to its original configuration allowing the post with attached end fitting 9 to be reconnected thereto.

One alternative embodiment of the invention is depicted in FIG. 5 which has a similar post mount base 30 but includes an alternative configuration of post mount connecting means indicated by reference numeral 31 and an alternative configuration of post end fitting indicated by reference numeral 32.

In this embodiment the post mount connecting means 31 once again includes a base section 33 which is retained in socket 34 in the base 30 by means of fastener 35 and the connecting means 31 further includes an annular engagement section 36 having a radial projection 37 about the periphery thereof. In this embodiment however a retaining plate 38 is provided in association with the post end fitting 32 and as can be seen the plate 38 provides a re-entrant lip 39 which, when the fitting 32 is in position on the base 30, is retained beneath the radial projection 37 on the connecting means 31. A plurality of set screws or like fasteners 40 fixes the plate 38 onto the lower end of the post end fitting 32.

On a displacing force being applied to post 41 retained in the end fitting 32, the projection 37 on the post mount connecting means 31 is elastically deformed or displaced which allows the end fitting 32 to fall clear of the base 30 prior to any substantial damage being inflicted on the post 41. The connecting means 31 then recovers to its original shape.

The plate 38 is preferably formed in a plurality of sections and to re-associate the end fitting 32 with the base 30 the sections forming the plate 38 are removed from the end fitting 32 and placed in position beneath the radial projection 37 on the connection means 31. The end fitting 32 is then re-attached to the plate by means of fasteners 40.

It will thus be appreciated that the present invention provides a simple yet effective means of mounting a post which, at least in the preferred embodiment described, has the following advantages.

1. When the posts are subjected to a displacing force which, under normal circumstances would damage the post, the post merely disassociates itself from its base and can thereafter be simply fixed back into position.
2. The act of displacing the post from its mount does not damage any of the mounting components.
3. Because the linking member is resilient some minor displacement of the post can occur without damage or disassociation occuring.

We claim:

1. A post mounting assembly comprising:

a post mounting base;

a post end fitting;

means to attach said post end fitting to one end of a post;

a socket in said post end fitting;

an elastically deformable post mount connecting means for releasably attaching said post end fitting in substantially fixed position with said base having a base section and an annular engagement section;

said annular engagement section being receivable within said socket;

means for attaching said base section to said base; and complementary male and female screw-thread sections on said annular engagement section and interior surface of said socket, so that said post is disengageable from said base by elastic deformation of said post mount connecting means and reattachable to said base upon elastic recovery of said connecting means.

2. An assembly as claimed in claim 1 wherein:

said post end fitting and said base have mating surfaces which mate when said post end fitting is fully engaged with said post mount connecting means; and further comprising, means on said mating surfaces to prevent relative rotation between said post end fitting and said base when fully engaged which would disassociate said post end fitting from said base.

3. An assembly as claimed in claim 2 wherein said means to prevent relative rotation comprises:

cooperating projections.

4. A post mounting assembly comprising:

a post mounting base;

an elastically deformable resilient connecting means operatively mounted between said base and one end of a post having a longitudinal axis to support the post on said base;

first impact releasable engagement means on said connecting means extending substantially perpendicularly to the post axis;

second engagement means operatively provided on the assembly releasably engageable with said first engagement means to releasably retain the post on said base; and anti-rotation means to prevent relative rotation between the post and said base when said post is supported on said base for use;

so that said post is disengageable from said base by elastic deformation of said connecting means and reattachable to said base upon elastic recovery of said connecting means.

5. An assembly as claimed in claim 4 and further comprising:

a post end fitting;

means to attach said post end fitting to one end of the post; and wherein said second engagement means is on said post end fitting.

6. An assembly as claimed in claim 5 and further comprising:

a socket in said post end fitting;

an annular engagement section on said connecting means adapted to be receivable within said socket;

a base section on said connecting means;

means to attach said base section to said base; and wherein said first engagement means is on said annular engagement section; and said second engagement means is in said socket.

7. An assembly as claimed in claim 6 wherein:

said first and second engagement means comprise complementary engageable male and female screw threads respectively.

8. An assembly as claimed in claim 6 and further comprising:

cooperating mating surfaces on said post end fitting and said base which are in mating position when said post end fitting is fully engaged with said connecting means; and wherein said anti-rotation means are on said mating surfaces.

9. An assembly as claimed in claim 8 wherein said anti-rotation means comprises cooperating projections.

* * * * *